US010665152B2

(12) United States Patent
Cho et al.

(10) Patent No.: US 10,665,152 B2
(45) Date of Patent: May 26, 2020

(54) LIGHT EMITTING DIODE DISPLAY DEVICE AND METHOD OF OPERATING THE SAME

(71) Applicant: SAMSUNG ELECTRONICS CO., LTD., Suwon-si, Gyeonggi-do (KR)

(72) Inventors: Young-hoon Cho, Yongin-si (KR); Ji-yong Park, Suwon-si (KR); Sang-kyun Im, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 150 days.

(21) Appl. No.: 15/696,896

(22) Filed: Sep. 6, 2017

(65) Prior Publication Data

US 2018/0068610 A1 Mar. 8, 2018

(30) Foreign Application Priority Data

Sep. 6, 2016 (KR) ..... 10-2016-0114452

(51) Int. Cl.
*G09G 3/32* (2016.01)
*G09G 3/3216* (2016.01)

(52) U.S. Cl.
CPC ..... *G09G 3/32* (2013.01); *G09G 3/3216* (2013.01); *G09G 2310/065* (2013.01); *G09G 2310/08* (2013.01); *G09G 2320/0247* (2013.01)

(58) Field of Classification Search
CPC .. G09G 3/32; G09G 3/3216; G09G 2310/065; G09G 2310/08; G09G 2320/0247
See application file for complete search history.

(56) References Cited

U.S. PATENT DOCUMENTS

2005/0083280 A1 4/2005 Hiraki et al.
2005/0184933 A1 8/2005 Tomohara
2006/0132402 A1 6/2006 Yu
2006/0238466 A1* 10/2006 Chen ..... G09G 3/3406 345/82
2007/0262732 A1* 11/2007 Shen ..... G09G 3/342 315/312

(Continued)

FOREIGN PATENT DOCUMENTS

JP 2011-242570 12/2011
KR 10-2016-0017841 2/2016

OTHER PUBLICATIONS

International Search Report dated Dec. 1, 2017, in corresponding International Patent Application No. PCT/KR2017/009606, 7 pgs.

(Continued)

*Primary Examiner* — Jose R Soto Lopez
(74) *Attorney, Agent, or Firm* — Staas & Halsey LLP

(57) ABSTRACT

A method of operating a light emitting diode (LED) display device is provided. The method includes determining idle time periods respectively corresponding to LED driving clock signals, based on a number of LED driving clock signals corresponding to one frame, controlling generation of the LED driving clock signals, based on the determined idle time periods, and driving an LED module in a unit of an LED line, based on the generated LED driving clock signals. As the LED display device automatically adjusts idle time periods of the LED driving clock signals, the occurrence of flicker in the LED display device may be reduced.

18 Claims, 7 Drawing Sheets

(56) References Cited

U.S. PATENT DOCUMENTS

| | | | | |
|---|---|---|---|---|
| 2007/0291198 | A1* | 12/2007 | Shen | G09G 3/3413 349/69 |
| 2008/0272276 | A1* | 11/2008 | Huang | G09G 3/3406 250/205 |
| 2010/0134406 | A1 | 6/2010 | Maruyama et al. | |
| 2012/0086740 | A1* | 4/2012 | Murai | G09G 3/3406 345/690 |
| 2012/0182209 | A1 | 7/2012 | Tuikkanen et al. | |
| 2016/0044757 | A1 | 2/2016 | Koo | |
| 2016/0118026 | A1* | 4/2016 | Loo | G09G 3/32 345/539 |

OTHER PUBLICATIONS

Written Opinion of the International Search Authority dated Dec. 1, 2017, in corresponding International Patent Application No. PCT/KR2017/009606, 7 pgs.

Extended European Search Report dated Feb. 19, 2019 in corresponding European Patent Application No. 17849029.8 (11 pages).

* cited by examiner

LIGHT EMITTING DIODE DISPLAY DEVICE AND METHOD OF OPERATING THE SAME

CROSS-REFERENCE TO RELATED APPLICATION

This application claims the benefit of Korean Patent Application No. 10-2016-0114452, filed on Sep. 6, 2016, in the Korean Intellectual Property Office, the disclosure of which is incorporated herein in its entirety by reference.

BACKGROUND

1. Field

The present disclosure relates to a method of operating a light emitting diode (LED) display device for reduction of flicker therein, the LED display device, and a non-transitory computer-readable recording medium having recorded thereon a program that performs the method.

2. Description of the Related Art

In general, a light emitting diode (LED) display device is a representative passive matrix device, has a pixel structure in which LEDs are arranged at regular intervals, and expresses a variety of colors through RGB combinations, thereby producing images. LED display devices are widely used in outdoor billboards and released as televisions (TVs) including LEDs. Recently, LED display devices are also frequently used as various types of outdoor media on rooftops and walls of buildings, and at events and exhibitions.

The LED display devices display screens by quickly repeating lighting and refreshing tens to hundreds of times per second. When a lighting cycle and a refresh cycle are different, fine shaking or blinking occurs on the screens. This fine shaking or blinking is referred to as flicker, and flicker may cause eye strain, reduced concentration, dizziness, etc. When a resolution or a frame rate of input image signals changes, there is a high possibility of flicker.

SUMMARY

Provided are a light emitting diode (LED) display device for adjusting idle time periods respectively corresponding to LED driving clock signals so as to reduce flicker, a method of operating the LED display device, and a non-transitory computer-readable recording medium having recorded thereon a program for performing the method.

Additional aspects will be set forth in part in the description which follows and, in part, will be apparent from the description, or may be learned by practice of the presented embodiments.

According to an aspect of an embodiment, an LED display device includes: an LED module including at least one LED line; a controller configured to determine idle time periods respectively corresponding to LED driving clock signals, based on a number of LED driving clock signals corresponding to one frame, and control generation of the LED driving clock signals, based on the determined idle time periods; and an LED driver configured to drive the LED module in a unit of the at least one LED line, based on the generated LED driving clock signals.

According to an aspect of another embodiment, a method of operating an LED display device, includes: determining idle time periods respectively corresponding to LED driving clock signals, based on a number of LED driving clock signals corresponding to one frame; controlling generation of the LED driving clock signals, based on the determined idle time periods; and driving an LED module in a unit of an LED line, based on the generated LED driving clock signals.

According to an aspect of another embodiment, a non-transitory computer-readable recording medium has embodied thereon at least one program including instructions for performing the method.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
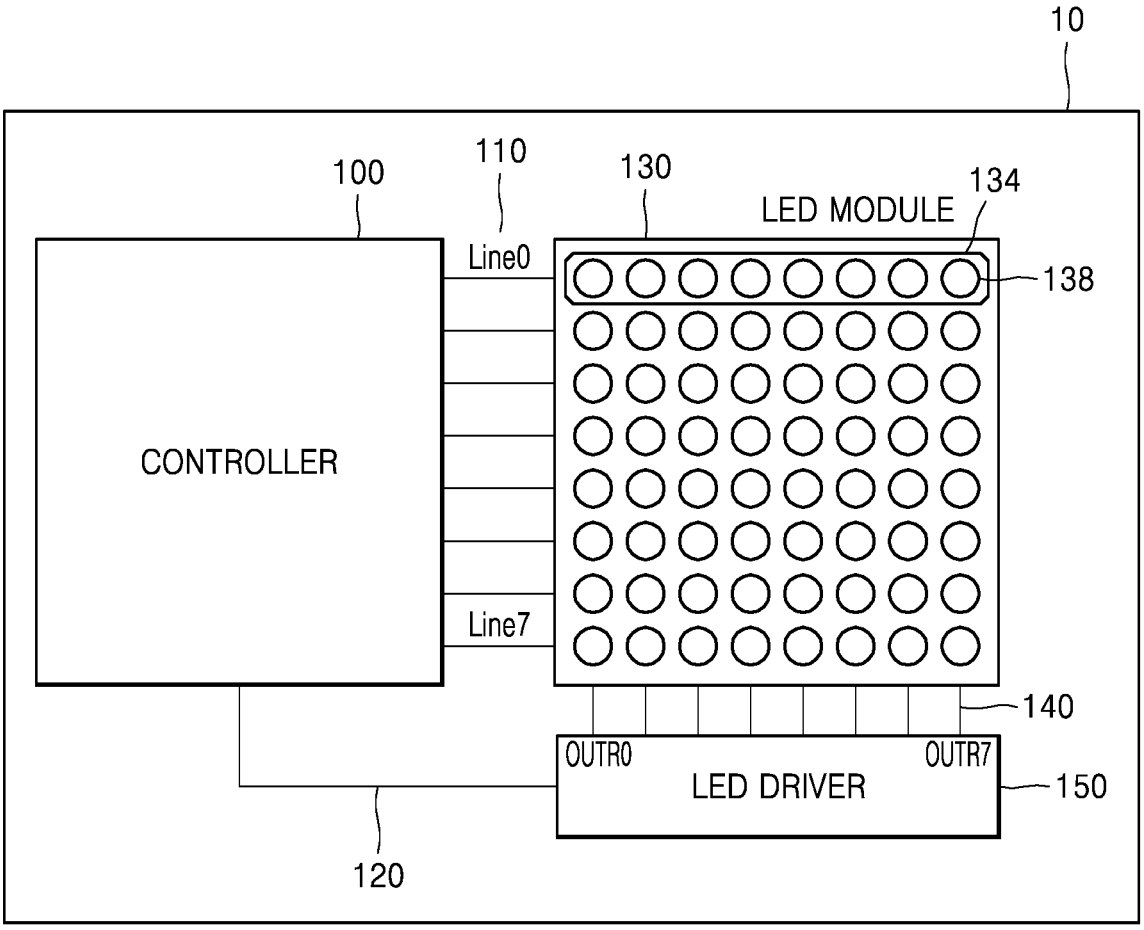
FIG. 1 is a block diagram of a structure of a light emitting diode (LED) display device according to an embodiment.

The terms used herein will be briefly described, and then the present disclosure will be described in detail by explaining embodiments of the disclosure with reference to the attached drawings.

The terms used in this specification are those general terms currently widely used in the art in consideration of functions regarding the present disclosure, but the terms may vary according to the intention of those of ordinary skill in the art, precedents, or new technology in the art. Also, specified terms may be selected by the applicant, and in this case, the detailed meaning thereof will be described in the detailed description of the present disclosure. Thus, the terms used in the specification should be understood not as simple names but based on the meaning of the terms and the overall description of the disclosure.

It will be further understood that the terms "comprise" and/or "include" used herein specify the presence of stated features or components, but do not preclude the presence or addition of one or more other features or components. Also, the terms "unit", "module", etc. are units for processing at least one function or operation and may be implemented as hardware, software, or a combination of hardware and software.

Reference will now be made in detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects. For clarity, portions that are irrelevant to the descriptions of the disclosure are omitted, and like reference numerals refer to like elements throughout. Expressions such as "at least one of", when preceding a list of elements, modify the entire list of elements and do not modify the individual elements of the list.

FIG. 1 is a block diagram of a structure of a light emitting diode (LED) display device, according to an embodiment.

Referring to FIG. 1, the LED display device 10 according to an embodiment may include a controller 100, an LED module 130, and an LED driver 150.

The LED module 130 according to an embodiment may be an electronic component including at least one LED mounted on a substrate. In an embodiment, the LED module 130 may include at least one LED line 134. Each of at least one_LED line 134 may be a collection of one or more light emitting devices 138 in rows or columns. Each light emitting device 138 may quickly repeat lighting and refreshing tens or hundreds of times per second and thus may display a screen.

The LED module 130 according to an embodiment may be driven in units of LED lines 134 according to a signal 110 from the controller 100. For example, as illustrated in FIG. 1, when it is assumed that the LED module 130 includes eight LED lines 134 and the LED lines 134 are respectively referred to as Line 0 to Line 7, when the controller 100 transmits a signal to the Line 0, the LED line 134 corresponding to the Line 0 may be driven in the LED module 130.

Also, in an embodiment, the LED lines 134 of the LED module 130 may be sequentially driven. For example, after the Line 0 is turned on and then off, the Line 1 may be turned on and off, and then the Lines 2 to 7 may be turned on and off in sequence. After the Line 7 is turned on and off, the Line 0 may be turned on and off again. However, an order in which the LED lines 134 are driven is not limited thereto and may vary.

In an embodiment, in order to control respective light emitting devices 138 included in each LED line 134, the LED module 130 may receive a signal 140 from the LED driver 150. For example, when one LED line 134 includes eight light emitting devices 138, the LED driver 150 may transmit, to the LED module 130, the signal 140 for controlling each light emitting device 138. In an embodiment, the signal 140 transmitted by the LED driver 150 to the LED module 130 may be synchronized with an LED driving clock signal 120 that is transmitted by the controller 100 to the LED driver 150.

In an embodiment, the LED module 130 may select the LED line 134 to be driven as the signal 110 is received from the controller 100, and may select which one of the light emitting devices 138 included in the selected LED line 134 is to be turned on and off according to the signal 140 received from the LED driver 150. Each light emitting device 138 may include a pixel at a point where two electrodes cross each other at a right angle.

The controller 100 according to an embodiment generally drives and controls the LED display device 10. For example, the controller 100 may control the LED driver 150 by using the LED driving clock signals 120 and may transmit a signal 110 to the LED module 130 to thus select the LED line 134 to be driven in the LED module 130.

In an embodiment, the controller 100 may receive an input image signal from the outside and may control the LED module 130 and the LED driver 150 based on the received input image signal. Also, the controller 100 may control the LED module 130 and the LED driver 150 in a frame unit. A frame may be distinguished by a signal from among input image signals. The signal that distinguishes the frame may be a vertical synchronization signal, but is not limited thereto.

The LED driver 150 according to an embodiment may be a semiconductor or an integrated circuit that provides a driving signal and data as an electrical signal in order to drive each light emitting device 138 included in the LED module 130. For example, the LED driver 150 may receive the LED driving clock signal 120 from the controller 100 in order to determine a point in time when each LED line 134 included in the LED module 130 is to be turned on, and may control which one of the light emitting devices 138 included in each LED line 134 is to be turned on according to the determined point in time.

Figure 2:
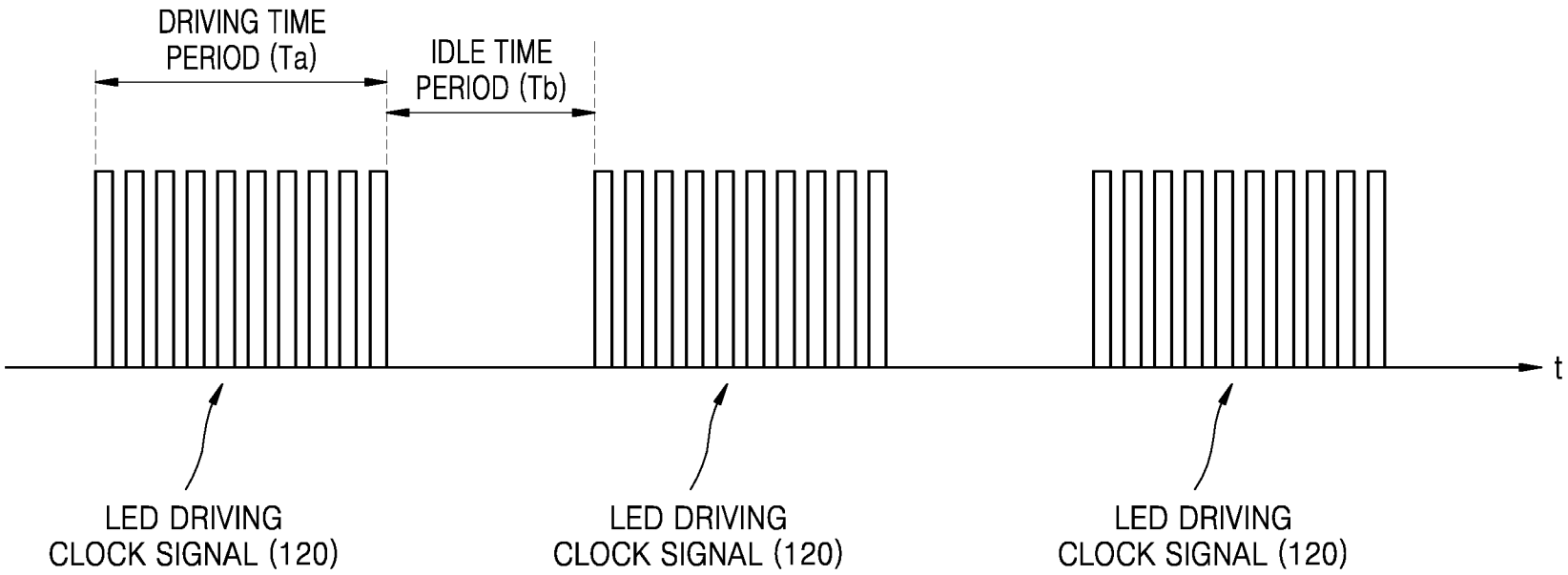
FIG. 2 illustrates LED driving clock signals according to an embodiment.

FIG. 2 illustrates LED driving clock signals 120 according to an embodiment.

FIG. 2 illustrates examples of the LED driving clock signals 120 transmitted by the controller 100 to the LED driver 150.

The LED driving clock signal 120 according to an embodiment is a type of clock signal. A clock signal is a square wave signal in which a logical state H (high, logic 1) and a logical state L (low, logic 0) periodically appear. In an embodiment, the controller 100 may transmit the LED driving clock signal 120 to the LED driver 150 and may determine a point in time when the light emitting device 138 is to be turned on. For example, when the controller 100 transmits the LED driving clock signal 120 corresponding to the logical state H to the LED driver 150, the LED driver 150 may transmit, to the LED module 130, a signal 140 for turning on the light emitting device 138.

Also, in an embodiment, the LED driving clock signal 120 may be transmitted by the controller 100 to the LED driver 150 during a driving time period Ta. For example, as illustrated in FIG. 2, the LED driving clock signal 120 may be transmitted by the controller 100 to the LED driver 150 during the driving time period Ta, but may not be transmitted by the controller 100 to the LED driver 150 during an idle time period Tb. In an embodiment, during the idle time period Tb when the LED driving clock signal 120 is not transmitted to the LED driver 150, the LED driver 150 may prepare for turning on a next LED line 134.

The LED driving clock signal 120 according to an embodiment may be transmitted by the controller 100 to the LED driver 150 as the driving time period Ta and the idle time period Tb repeatedly appear. The driving time period Ta and the idle time period Tb corresponding to each LED driving clock signal 120 may be determined. In an embodiment, the driving time period Ta may be determined based on the number of clock signals included in the LED driving clock signal 120, and the number of clock signals may be set in advance based on specifications of the LED driver 150. For example, when 257 clock signals are required according to the specifications of the LED driver 150, a time period until when the number of clock signals included in the LED driving clock signal 120 becomes 257 may be a driving time period Ta.

In an embodiment, the LED driving clock signal 120 may be controlled to be generated by the controller 100 based on an input image signal. For example, when the LED display device 10 receives an input image signal including multiple clock signals, the controller 100 may control the generation of the LED driving clock signal 120 by intactly passing some of the received clock signals. A time period when the clock signals included in the input image signal are intactly passed by the controller 100 may correspond to the driving time period Ta. Also, the controller 100 may not pass others of the received clock signals. A time period when the controller 100 does not pass the clock signals may correspond to the idle time period Tb.

Also, in an embodiment, the controller 100 may control the generation of the LED driving clock signals 120 in a frame unit. The number of LED driving clock signals 120 corresponding to one frame may be determined in advance based on the input image signal. In addition, in an embodiment, the idle time periods respectively corresponding to the LED driving clock signals 120 corresponding to one frame may differ. In particular, an idle time period corresponding to the last one of the LED driving clock signals 120 corresponding to one frame may be longer than the idle time periods corresponding to the other LED driving clock signals 120. Due to light emitting devices that irregularly emit light or do not emit light repeatedly at a certain point in time, flicker, screen blinking, etc. may occur.

In an embodiment, the controller 100 may control the generation of the LED driving clock signals 120 in consideration of the number of LED lines 134 included in the LED module 130 within an interval corresponding to one frame. For example, when the LED display device including eight LED lines 134 receives an input image signal including a number of clock signals that are sufficient enough to generate 17 LED driving clock signals 120, the controller 100 may control the generation of the LED driving clock signals 120 such that only eight LED driving clock signals 120, not 17 LED driving clock signals 120, are generated. Also, the controller 100 may control the generation of the LED driving clock signals 120 such that only 16 LED driving clock signals 120, which is a multiple of 2 of the number of LED lines 134, may be generated. Therefore, within the interval corresponding to one frame, the idle time period corresponding to the last LED driving clock signal 120 for driving the last LED line 134 may be longer than the idle time periods corresponding to the rest of the LED driving clock signals 120.

In an embodiment, when the controller 100 controls the generation of the LED driving clock signals 120 by considering the number of LED lines 134 included in the LED module 130 within the interval corresponding to one frame, the number of LED driving clock signals 120 corresponding to one frame may be determined based on the number of LED lines 134 and the number of repetitions of the driving time period Ta for one LED driving clock signal 120 within the interval corresponding to one frame. For example, when the number of LED lines 134 is 8 and the number of repetitions of the driving time period of one LED driving clock signal 120 is 8 within the interval corresponding to one frame, the total number of LED driving clock signals 120 corresponding to one frame may be 64.

Figure 3:
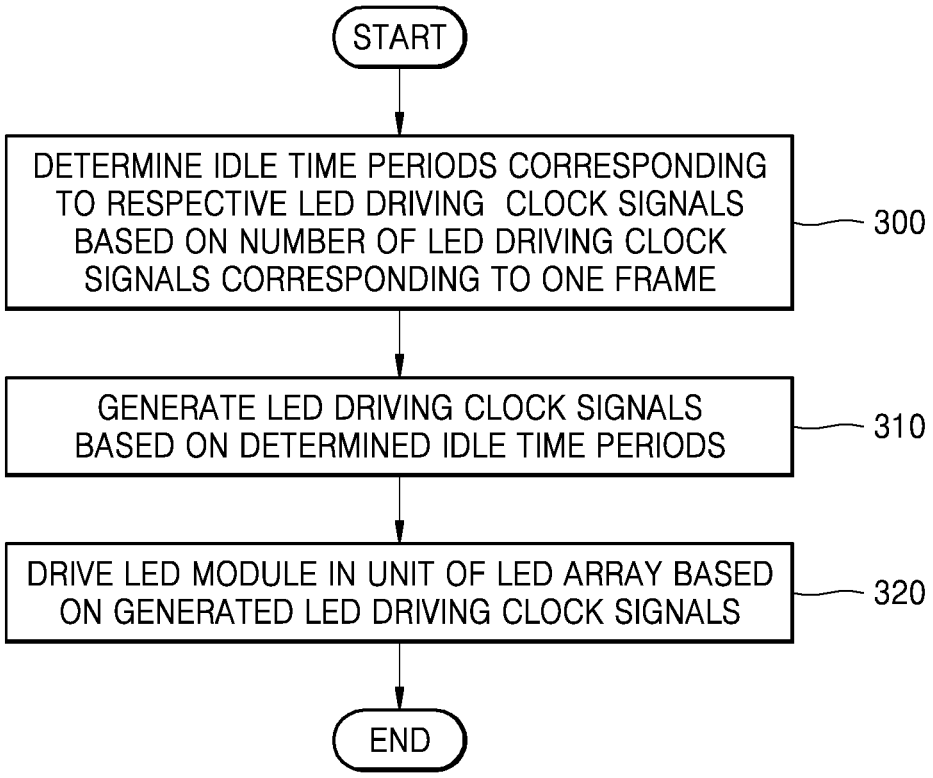
FIG. 3 is a flowchart of a method in which an LED display device determines an idle time period corresponding to each LED driving clock signal, according to an embodiment.

FIG. 3 is a flowchart of a method in which the LED display device determines an idle time period corresponding to each LED driving clock signal, according to an embodiment.

Referring to FIG. 3, in operation 300, the LED display device may determine the idle time period corresponding to each LED driving clock signal based on the number of LED driving clock signals corresponding to one frame.

In an embodiment, the LED display device may generate the LED driving clock signals during a driving time period within an interval corresponding to one frame and may not generate the LED driving clock signals during an idle time period. In an embodiment, within the interval corresponding to one frame, the driving time period and the idle time period may be alternately repeated. One LED driving clock signal has a corresponding driving time period and idle time period, and thus the number of LED driving clock signals corresponding to one frame may be identical to the number of repetitions of the driving time period and the idle time period within the interval corresponding to one frame.

In an embodiment, the LED display device may extract signals for distinguishing frames and may count the number of LED driving clock signals corresponding to intervals between adjacent signals from among the signals, thereby determining the number of LED driving clock signals corresponding to one frame. The signals for distinguishing the frames may be vertical synchronization signals Vsync. For example, the LED display device may extract vertical synchronization signals Vsync included in the input image signal and may determine an interval between adjacent vertical synchronization signals Vsync as an interval corresponding to one frame.

In an embodiment, the controller 100 may control the generation of the LED driving clock signals by considering the number of LED lines included in the LED module within the interval corresponding to one frame. For example, the controller 100 may control the generation of the LED driving clock signals in such a manner that the number of LED driving clock signals may be an integer of the number of LED lines within the interval corresponding to one frame. In this case, the last one of the LED driving clock signals corresponding to one frame may be an LED driving clock signal for driving a last one of the LED lines.

In an embodiment, the LED display device may divide part of an idle time period corresponding to the last LED driving clock signal from among the LED driving clock signals corresponding to one frame, and may allocate the divided part of the idle time period to an idle time period corresponding to at least one of the rest of LED driving clock signals other than the last LED driving clock signal.

In an embodiment, the LED display device may generate the LED driving clock signals based on a preset idle time period, and thus idle time periods corresponding to the rest of the LED driving clock signals corresponding to one frame, other than the last LED driving clock signal, may be identical to each other. Meanwhile, according to a point in time when the vertical synchronization signal Vsync is input, the idle time period corresponding to the last LED driving clock signal may be longer than the idle time periods corresponding to the rest of the LED driving clock signals. Also, in an embodiment, the idle time period corresponding to the LED driving clock for driving the last LED line may become longer than the idle time periods corresponding to the rest of the LED driving clock signals.

The LED display device according to an embodiment may divide part of the idle time period corresponding to the last LED driving clock signal and may allocate the divided part to the idle time period corresponding to at least one of the rest of the LED driving clock signals. Thus, all idle time periods may be uniform or almost uniform. For example, differences between the idle time periods respectively corresponding to the LED driving clock signals may be determined to be smaller than a threshold value. Accordingly, the LED display device may maintain lengths of all idle time periods to be almost uniform so that flicker may decrease.

In an embodiment, the LED display device may divide part of the idle time period, which corresponds to the last LED driving clock signal, by the number of LED driving clock signals and may allocate the divided part to the idle time period corresponding to at least one of the rest of the LED driving clock signals. For example, when the LED display device determines the number of LED driving clock signals, the number of repetitions of the idle time periods corresponding to the LED driving clock signals within the interval corresponding to one frame may be identified. Thus, based on the number of repetitions of the idle time periods, part of the idle time period corresponding to the last LED driving clock signal may be divided and uniformly allocated to the idle time periods corresponding to the rest of the LED driving clock signals.

Also, in an embodiment, the LED display device may not immediately divide, by the number of LED driving clock signals, part of the idle time period corresponding to the last LED driving clock signal but may divide the part of the idle time period by a value, which is determined by using the number of LED driving clock signals according to a certain algorithm, thereby allocating the divided part to the idle time periods corresponding to the rest of the LED driving clock signals.

As a result of determining the idle time periods through the above-described processes, a first idle time period, which corresponds to the last LED driving clock signal from among the LED driving clock signals corresponding to one frame, may be identical to a second idle time period corresponding to any one of the rest of the LED driving clock signals other than the last LED driving clock signal.

In an embodiment, the LED display device may determine an idle time period in response to a change in at least one of a resolution and a frame rate of input image signals.

For example, when the resolution or the frame rate of the input image signals that are input to the LED display device changes, a length of an interval corresponding to one frame may change. As the length of the interval corresponding to one frame changes, the idle time period corresponding to the last LED driving clock signal may change differently from the idle time periods corresponding to the rest of the LED driving clock signals. Accordingly, the LED display device may determine all of the idle time periods uniformly or almost uniformly by dividing and allocating part of the idle time period through the above processes.

In operation 310, the LED display device may generate LED driving clock signals based on the determined idle time periods. In an embodiment, when the LED display device generates the LED driving clock signals based on the idle time periods determined in operation 300, all of the LED driving clock signals may be generated while having uniform or almost uniform idle time periods. In an embodiment, since the driving time periods of the LED driving clock signals are fixed, all of the LED driving clock signals may be generated while having driving time periods of the same length and idle time periods of the same length.

In operation 320, the LED display device may drive the LED module in units of LED lines, based on the generated LED driving clock signals. In an embodiment, the LED display device drives the LED module in units of LED lines based on the LED driving clock signals having uniform or almost uniform idle time periods, and thus a cycle in which each LED line is driven and idled may be uniformly maintained. Therefore, flicker occurring while the LED display device operates may decrease.

Figure 4:
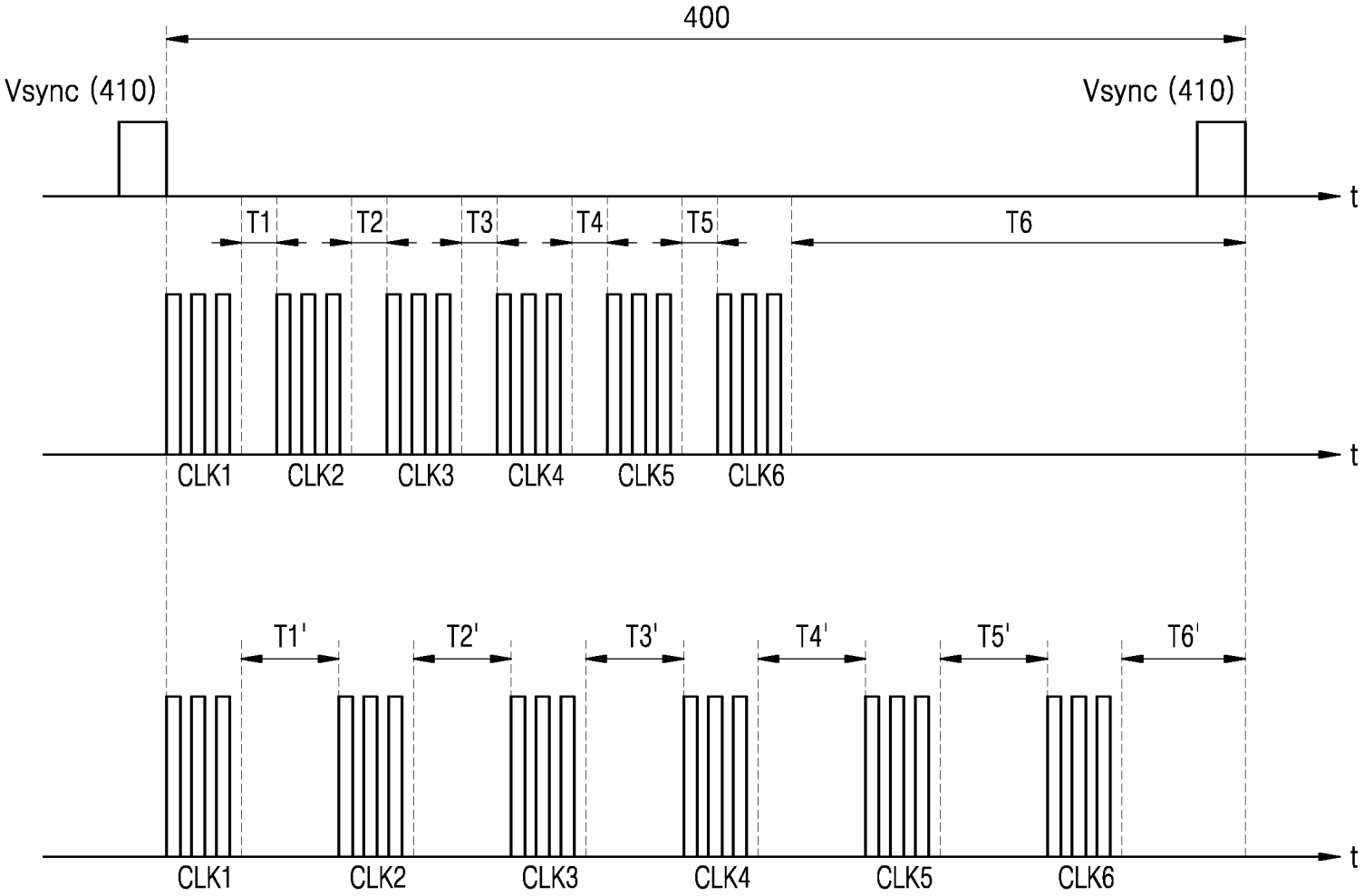
FIG. 4 illustrates an example of a method in which an LED display device determines an idle time period corresponding to each LED driving clock signal, according to an embodiment.

FIG. 4 illustrates an example of a method in which the LED display device determines idle time periods respectively corresponding to the LED driving clock signals, according to an embodiment.

Referring to FIG. 4, as the LED display device extracts adjacent vertical synchronization signals Vsync 410, one frame 400 may be determined. In the example of FIG. 4, the LED display device generates six LED driving clock signals CLK1 to CLK6 during an interval corresponding to the frame 400. Each of the LED driving clock signals CLK1 to CLK6 includes three clock signals. In an embodiment, the generation of three clock signals by the LED display device during driving time periods of the LED driving clock signals CLK1 to CLK6 may be determined in advance according to specifications of the LED driver.

In an embodiment, idle time periods corresponding to the LED driving clock signals CLK1 to CLK6 may be respectively indicated as T1 to T6. Since the LED display device generates the LED driving clock signals CLK1 to CLK6 based on the idle time periods that are determined in advance, the idle time periods T1 to T5 may be identical to each other. However, if the vertical synchronization signal Vsync is not input according to the idle time periods that are determined in advance, the idle time period T6 corresponding to the last LED driving clock signal may be longer than the idle time periods T1 to T5 within the interval corresponding to the frame 400. Therefore, when such a frame is repeated and a screen is displayed, only an idle time period corresponding to a last LED driving clock signal may extend within an interval corresponding to each frame, and thus screen blinking or flicker may occur.

Also, in an embodiment, when the number of LED lines included in the LED display device is 6, the last LED driving clock signal, that is, the LED driving clock CLK6, may drive the last LED line. In this case, the idle time period T6 corresponding to the LED driving clock CLK6 for driving the last LED line may become longer than the idle time periods T1 to T5 corresponding to the rest of the LED driving clock signals CLK1 to CLK5. Therefore, when such a frame is repeated and a screen is displayed, only an idle time period corresponding to a last LED driving clock signal for driving a last LED line may extend within an interval corresponding to each frame, and thus screen blinking or flicker may occur.

In an embodiment, in order to solve the above problem, the LED display device may divide and uniformly allocate part of the idle time period T6 corresponding to the last LED driving clock signal to the idle time periods T1 to T5 based on the number of LED driving clock signals. Also, the LED display device may appropriately divide part of the idle time period T6 and may allocate the divided part only to the idle time periods T3 to T5. A method in which the LED display device allocates the idle time period based on the number of LED driving clock signals may vary, but the method is not limited to the above examples.

In an embodiment, via the above-described method, the LED display device may appropriately divide the idle time periods respectively corresponding to the LED driving clock signals and allocate the divided idle time periods to other idle time periods, thus determining new idle time periods T1' to T6'. The new idle time periods T1' to T6' may be uniform or similar to each other. For example, differences between the idle time periods T1' to T6' may be smaller than a threshold value. Accordingly, flicker occurring due to the operation of the LED display device may decrease.

Figure 5:
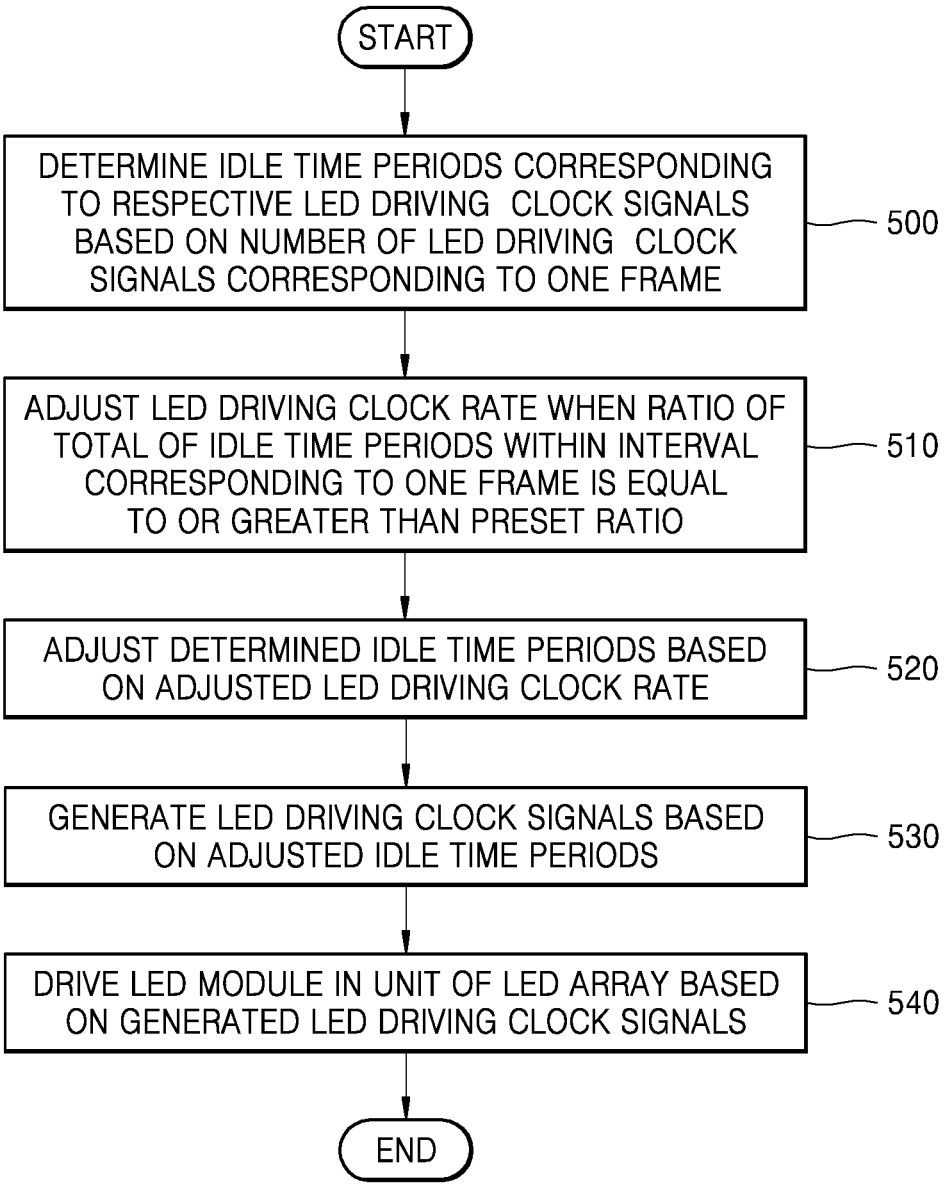
FIG. 5 is a flowchart of a method in which an LED display device adjusts an LED driving clock rate and determines an idle time period corresponding to each LED driving clock signal, according to an embodiment.

FIG. 5 is a flowchart of a method in which the LED display device adjusts an of LED driving clock rate and determines an idle time period corresponding to each LED driving clock signal, according to an embodiment.

Referring to FIG. 5, in operation 500, the LED display device may determine the idle time period corresponding to each LED driving clock signal based on the number of LED driving clock signals corresponding to one frame. Descriptions regarding operation 500 of FIG. 5 may be identical to those regarding operation 300 of FIG. 3.

In operation 510, when a ratio of a total of the idle time periods within an interval corresponding to one frame is equal to or greater than a preset ratio, the LED display device may adjust the LED driving clock rate. The LED driving clock rate is a rate of clock signals included in each LED driving clock signal. For example, when the LED display device, which has generated 2 clock signals per second, starts to generate one clock signal per second, the LED driving clock rate is decreased one-half times.

In an embodiment, when the ratio of the total of the idle time periods within the interval corresponding to one frame is equal to or greater than a preset ratio, the idle time periods are much longer than the driving time periods so that luminance of the screen displayed by the LED display device may decrease. The decrease in the luminance may be caused because the idle time periods corresponding to all of the LED driving clock signals become excessively long during the division and allocation of the idle time periods for flicker reduction.

In an embodiment, the LED display device may adjust the LED driving clock rate so as to increase a duration during which the light emitting devices emit light. For example, when the ratio of the total of the idle time periods within the interval corresponding to one frame is equal to or greater than 40%, the LED display device may decrease the LED driving clock rate one-half times and double the duration during which the light emitting devices emit light, thereby increasing the luminance of the screen.

In operation 520, the LED display device may adjust the idle time periods determined based on the adjusted LED driving clock rate. In an embodiment, as the LED display device decreases the LED driving clock rate, the driving time period corresponding to each LED driving clock signal may increase. Accordingly, the idle time period corresponding to each LED driving clock signal may decrease within the interval corresponding to one frame, and thus the luminance of the screen displayed by the LED display device may increase.

In operation 530, the LED display device may generate the LED driving clock signals based on the adjusted idle time periods. In an embodiment, when the LED display device generates the LED driving clock signals based on the driving time periods and the idle time periods that are adjusted in operation 520, all of the LED driving clock signals may not only have uniform or almost uniform idle time periods, but also have sufficient driving time periods.

In operation 540, based on the generated LED driving clock signals, the LED module may be driven in units of LED lines. In an embodiment, the LED display device may drive the LED lines to display the screen while maintaining the uniform idle time periods and the driving time periods.

Figure 6:
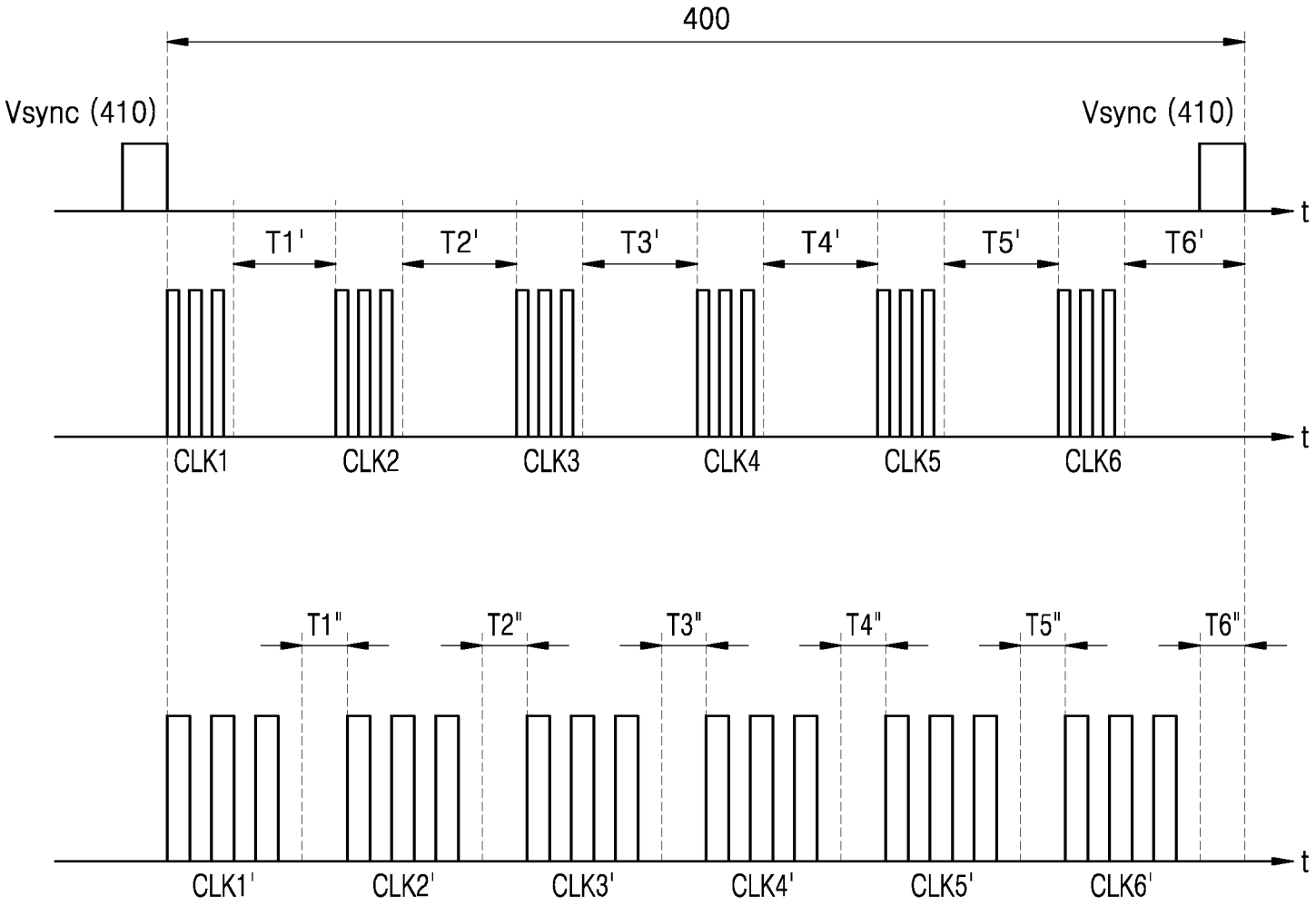
FIG. 6 illustrates an example of a method in which an LED display device adjusts an LED driving clock rate and determines an idle time period corresponding to each LED driving clock signal, according to an embodiment.

FIG. 6 illustrates an example in which the LED display device adjusts the LED driving clock rate and determines an idle time period corresponding to each LED driving clock signal, according to an embodiment.

Referring to FIG. 6, as the LED display device extracts adjacent vertical synchronization signals 410, one frame 400 may be determined. In the example of FIG. 6, the LED display device generates six LED driving clock signals CLK1 to CLK6 during the interval corresponding to the frame 400. Each of the LED driving clock signals CLK1 to CLK6 includes three clock signals.

Also, the idle time periods T1' to T6' of FIG. 6 respectively corresponding to the LED driving clock signals may be the idle time periods determined by the LED display device to decrease the flicker, as described with reference to FIG. 4.

Referring to FIG. 6, within the interval corresponding to the frame 400, it is found that a total of the idle time periods, that is, T1'+T2'+T3'+T4'+T5'+T6', is quite long, in comparison to driving time periods of the LED driving clock signals CLK1 to CLK6. Therefore, the luminance of the screen displayed by the LED display device may be low.

In order to solve such a problem, the clock rate of the LED driving clock signals CLK1 to CLK6 is decreased one-half times, and thus the driving time periods corresponding to the LED driving clock signals CLK1 to CLK6 may increase. In an embodiment, LED driving clock signals having the adjusted clock rate may be LED driving clock signals CLK1' to CLK6'.

Also, in an embodiment, as the LED driving clock rate is adjusted, driving time periods of the LED driving clock signals CLK1' to CLK6' increase, and accordingly, idle time periods respectively corresponding to LED driving clock signals CLK1' to CLK6' decrease. When the decreased idle time periods are respectively referred to as idle time periods T1" to T6", the idle time periods T1" to T6" may be uniform or similar to each other, and a total of the idle time periods T1" to T6", that is, T1"+T2"+T3"+T4"+T5"+T6", may be less than or equal to a preset ratio within the interval corresponding to one frame.

In an embodiment, when a ratio of the total of the idle time periods is equal to or greater than a preset ratio within the interval corresponding to one frame, the LED display device adjusts the LED driving clock rate and adjusts the idle time periods that are determined based on the adjusted rate of the LED driving clock signals so that the luminance of the screen may be maintained at a certain level or higher and flicker may decrease.

Figure 7:
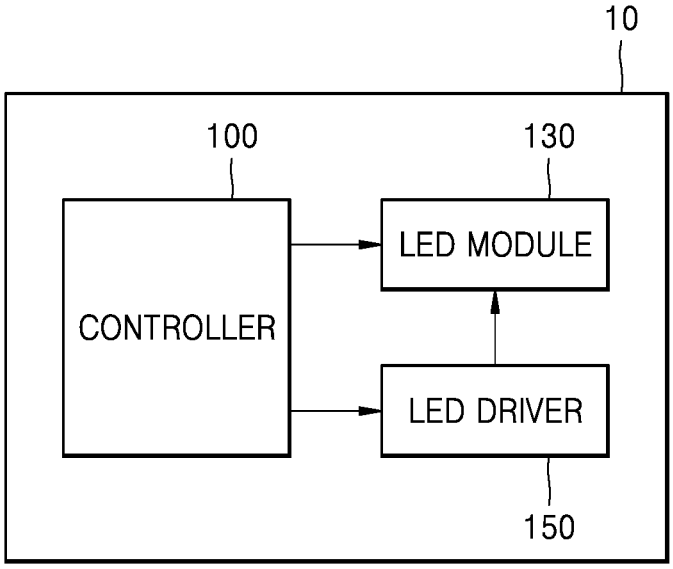
FIG. 7 is a block diagram of a structure of an LED display device according to an embodiment.

FIG. 7 is a block diagram of a structure of an LED display device 10, according to an embodiment.

Referring to FIG. 7, the LED display device 10 may include the controller 100, the LED module 130, and the LED driver 150.

The LED module 130 according to an embodiment may include at least one LED line. Each LED line may include multiple light emitting devices. Each light emitting device may display a screen by repeating quick refreshing and lighting tens to hundreds of times per second.

The LED module 130 according to an embodiment may be driven in units of LED lines according to a signal from the controller 100. Also, in an embodiment, the LED lines of the LED module 130 may be sequentially driven. In an embodiment, in order to control each light emitting device included in each LED line, the LED module 130 may receive a signal from the LED driver 150.

The controller 100 according to an embodiment may determine an idle time period corresponding to each LED driving clock signal based on the number of LED driving clock signals corresponding to one frame. In an embodiment, the controller 100 may control the generation of the LED driving clock signals within an interval corresponding to one frame such that the LED driving clock signals may be generated during the driving time periods and not generated during the idle time periods.

Also, the controller 100 according to an embodiment may extract signals for distinguishing frames and may count the number of LED driving clock signals corresponding to an interval between adjacent signals from among the extracted signals, thereby determining the number of LED driving clock signals corresponding to one frame. In an embodiment, the interval between the adjacent signals for distinguishing the frames may be an interval corresponding to one frame.

In an embodiment, the LED display device 10 may include a clock counter for counting a clock signal. The clock counter may count the number of clock signals included in an image signal input from the outside. In an embodiment, the controller 100 may control the clock counter to count the number of clock signals included in the input image signal.

In an embodiment, the controller 100 may control the generation of the LED driving clock signals based on the counted number of clock signals included in the input image signal. For example, the controller 100 may control the generation of the LED driving clock signals in accordance with a cycle in which the clock signals included in the input image signals are input. In this case, a rate of the clock signals included in the input image signals may be identical to the LED driving clock rate.

Also, in an embodiment, the controller 100 may adjust the LED driving clock rate differently from the rate of the clock signals included in the input image signal. For example, the controller 100 may control the generation of the LED driving clock signals in such a manner that one LED driving clock signal is generated whenever two clock signals are input from the outside. Thus, the LED driving clock rate may be decreased to a half of the rate of the clock signals that are input from the outside.

In an embodiment, the controller 100 may divide part of the idle time period corresponding to the last one of the LED driving clock signals corresponding to one frame and allocate the divided part to the idle time period corresponding to at least one of the rest of the LED driving clock signals other than the last LED driving clock signal, thus determining the idle time periods corresponding to the LED driving clock signals. In an embodiment, the controller 100 may determine all of the idle time periods corresponding to the LED driving clock signals corresponding to one frame to be uniform or almost uniform.

Also, the controller 100 may divide part of the idle time period corresponding to the last LED driving clock signal by the number of LED driving clock signals and may allocate the divided part to the idle time period corresponding to at least one of the rest of the LED driving clock signals. For example, if the controller 100 determines the number of LED driving clock signals, the number of repetitions of the idle time periods corresponding to the LED driving clock signals within the interval corresponding to one frame may be identified, and thus, based on the identified number of repetitions, part of the idle time period corresponding to the last LED driving clock signal may be uniformly allocated to the idle time periods corresponding to the rest of the LED driving clock signals.

Also, in an embodiment, the controller 100 may not immediately divide part of the idle time period corresponding to the last LED driving clock signal by the number of LED driving clock signals, but may divide part of the idle time period by a value, which is determined based on the number of LED driving clock signals according to a certain algorithm, thereby allocating the divided part to the idle time periods corresponding to the rest of the LED driving clock signals.

In an embodiment, a first idle time period, which corresponds to the last LED driving clock signal from among the LED driving clock signals corresponding to one frame, may be identical to a second idle time period corresponding to any one of the rest of the LED driving clock signals other than the last LED driving clock signal.

Also, in an embodiment, the controller 100 may determine the idle time periods in response to a change in at least one of a resolution and a frame rate of the input image signals. For example, when the resolution or frame rate of the image signals that are input to the LED display device 10 changes, a length of an interval corresponding to one frame may change. Thus, when the LED driving clock signals are generated based on the idle time periods that are determined in advance, lengths of the idle time periods may differ from one another within the interval corresponding to one frame. Accordingly, the controller 100 may uniformly determine the idle time periods via the above-described method.

In an embodiment, the controller 100 may control the generation of the LED driving clock signals based on the determined idle time periods. In an embodiment, when the controller 100 generates the LED driving clock signals based on the determined idle time periods, all of the LED driving clock signals may have uniform or almost uniform idle time periods.

In an embodiment, when the ratio of the total of the idle time periods is equal to or greater than a preset ratio within the interval corresponding to one frame, the controller 100 may adjust the rate of the LED driving clock signals. In an embodiment, when the ratio of the total of the idle time periods is equal to or greater than the preset ratio within the interval corresponding to one frame, the idle time periods become much longer than the driving time periods, and thus the luminance of a screen displayed by the LED display device 10 may decrease. The decrease in the luminance may be caused because the idle time periods corresponding to all of the LED driving clock signals become excessively long during the division and allocation of the idle time periods for flicker reduction.

In an embodiment, the controller 100 may adjust the LED driving clock rate and thus may increase a duration during which the light emitting devices emit light. For example, when the ratio of the total of the idle time periods is equal to or greater than 40% within the interval corresponding to one frame, the LED display device 10 decreases the LED driving clock rate one-half times and doubles the duration during which the light emitting devices emit light, thereby increasing the luminance of the screen.

Also, the controller 100 according to an embodiment may adjust the idle time periods determined based on the adjusted LED driving clock rate. In an embodiment, as the controller 100 decreases the LED driving clock rate, the driving time periods respectively corresponding to the LED driving clock signals may increase. Accordingly, within the interval corresponding to one frame, the idle time periods respectively corresponding to the LED driving clock signals may decrease, and the luminance of the screen displayed by the LED display device 10 may increase.

In an embodiment, the controller 100 may generate the LED driving clock signals based on the adjusted idle time periods. In an embodiment, when the controller 100 generates the LED driving clock signals based on the adjusted idle time periods and driving time periods, all of the LED driving clock signals may not only have uniform or almost uniform idle time periods, but also have sufficient driving time periods.

The LED driver 150 according to an embodiment may drive the LED module 130 in units of LED lines based on the generated LED driving clock signals. In an embodiment, the LED driver 150 may drive the LED lines to display the screen while maintaining the uniform idle time periods and the driving time periods.

The block diagrams of FIGS. 1 and 7 that illustrate the LED display device 10 are merely examples. The components of the block diagrams may be integrated or deleted, or other components may be added to the components illustrated in FIGS. 1 and 7. In other words, according to necessity, two or more components are integrated into one component, or one component may be divided into two or more components. In addition, functions performed by each block are provided to explain the embodiments, and specific operations or devices of the block do not limit the scope of the present disclosure.

The method of operating the LED display device according to an embodiment may be recorded on a non-transitory computer-readable recording medium on which one or more programs including instructions for performing the method have been recorded. Examples of the non-transitory computer-readable recording medium include magnetic storage media (e.g., floppy disks, hard disks, magnetic tapes, etc.), optical recording media (e.g., CD-ROMs, or DVDs), magneto-optical media (e.g., floptical disks), and hardware devices (e.g., ROM, RAM, flash memory, etc.) specifically designed to store and execute program instructions. Examples of the program instructions include machine language codes created by a compiler, or high-level language codes that may be executed by a computer by using an interpreter, or the like.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope as defined by the following claims.

What is claimed is:

1. A light emitting diode (LED) display device comprising:

a LED module comprising a plurality of LEDs, at least one LED line where the plurality of LEDs are arranged in line;

a controller configured to determine idle time periods respectively corresponding to LED driving clock signals in a frame, based on a number of LED driving clock signals in the frame, control generation of the LED driving clock signals, based on the determined idle time periods, and adjust a clock rate of the LED driving clock signals and the determined idle time periods based on the adjusted clock rate of the LED driving clock signals when a ratio of a total of the idle time periods is equal to or greater than a preset ratio within an interval in the frame;

and a LED driver configured to drive the LED module in a unit of the at least one LED line, based on the generated LED driving clock signals.

2. The LED display device of claim 1, wherein the controller is further configured to:

extract signals to distinguish frames;

count the number of LED driving clock signals corresponding to an interval between signals that are adjacent to each other from among the extracted signals; and determine the number of LED driving clock signals in the frame.

3. A light emitting diode (LED) display device comprising:

a LED module comprising a plurality of LEDs, at least one LED line where the plurality of LEDs are arranged in line;

a controller configured to determine idle time periods respectively corresponding to LED driving clock signals in a frame, based on a number of LED driving clock signals in the frame, and control generation of the LED driving clock signals, based on the determined idle time periods; and a LED driver configured to drive the LED module in a unit of the at least one LED line, based on the generated LED driving clock signals, wherein the controller is further configured to:

divide a part of an idle time period corresponding to a last one of the LED driving clock signals in the frame;

allocate the divided part to an idle time period corresponding to at least one of the rest of the LED driving clock signals, other than the last LED driving clock signal; and determine the idle time periods corresponding to the LED driving clock signals.

4. The LED display device of claim 3, wherein the controller is further configured to divide the part of the idle time period corresponding to the last LED driving clock signal by the number of LED driving clock signals, and allocate the divided part to the idle time period corresponding to the at least one of the rest of the LED driving clock signals.

5. The LED display device of claim 1, wherein a first idle time period corresponding to the last one of the LED driving clock signals in the frame is identical to a second idle time period corresponding to any one of the rest of the LED driving clock signals, other than the last LED driving clock signal.

6. The LED display device of claim 1, wherein the controller is further configured to determine the idle time periods in response to a change in at least one of a resolution or a frame rate of an image signal that is input to the LED display device.

7. A method of operating a light emitting diode (LED) display device, the method comprising:

determining idle time periods respectively corresponding to LED driving clock signals in a frame, based on a number of LED driving clock signals in the frame, controlling generation of the LED driving clock signals, based on the determined idle time periods;

adjusting a clock rate of the LED driving clock signals when a ratio of a total of the idle time periods is equal to or greater than a preset ratio within an interval in the frame;

adjusting the determined idle time periods based on the adjusted clock rate of the LED driving clock signals; and driving a LED module in a unit of a LED line, based on the generated LED driving clock signals.

8. The method of claim 7, wherein the determining of the idle time periods comprises:

extracting signals to distinguish frames; and counting the number of LED driving clock signals corresponding to an interval between signals that are adjacent to each other from among the extracted signals.

9. The method of claim 7, wherein the determining of the idle time periods comprises:

dividing a part of an idle time period corresponding to a last one of the LED driving clock signals in the frame and allocating the divided part to an idle time period corresponding to at least one of the rest of the LED driving clock signals, other than the last LED driving clock signal.

10. The method of claim 9, wherein the dividing of the part and the allocating of the divided part comprises:

dividing the part of the idle time period corresponding to the last LED driving clock signal by the number of LED driving clock signals and allocating the divided part to the idle time period corresponding to the at least one of the rest of the LED driving clock signals.

11. The method of claim 7, wherein a first idle time period corresponding to the last one of the LED driving clock signals in the frame is identical to a second idle time period corresponding to any one of the rest of the LED driving clock signals, other than the last LED driving clock signal.

12. The method of claim 7, wherein the determining of the idle time periods comprises determining the idle time periods in response to a change in at least one of a resolution or a frame rate of an image signal that is input to the LED display device.

13. A non-transitory computer-readable recording medium having embodied thereon at least one program comprising instructions to perform the method of operating a light emitting diode (LED) display device, the method comprising:

determining idle time periods respectively corresponding to LED driving clock signals in a frame, based on a number of LED driving clock signals in the frame;

controlling generation of the LED driving clock signals, based on the determined idle time periods;

adjusting a clock rate of the LED driving clock signals when a ratio of a total of the idle time periods is equal to or greater than a preset ratio within an interval in the frame;

adjusting the determined idle time periods based on the adjusted clock rate of the LED driving clock signals; and driving a LED module in a unit of a LED line, based on the generated LED driving clock signals.

14. The non-transitory computer-readable recording medium of claim 13, wherein the determining of the idle time periods comprises:

extracting signals for distinguishing frames; and counting the number of LED driving clock signals corresponding to an interval between signals that are adjacent to each other from among the extracted signals.

15. The non-transitory computer-readable recording medium of claim 13, wherein the determining of the idle time periods comprises:

dividing part of an idle time period corresponding to a last one of the LED driving clock in the frame and allocating the divided part to an idle time period corresponding to at least one of the rest of the LED driving clock signals, other than the last LED driving clock signal.

16. The non-transitory computer-readable recording medium of claim 15, wherein the dividing of the part and the allocating of the divided part comprises:

dividing the part of the idle time period corresponding to the last LED driving clock signal by the number of LED driving clock signals and allocating the divided part to the idle time period corresponding to the at least one of the rest of the LED driving clock signals.

17. The non-transitory computer-readable recording medium of claim 13, wherein a first idle time period corresponding to a last one of the LED driving clock signals in the frame is identical to a second idle time period corresponding to any one of the rest of the LED driving clock signals, other than the last LED driving clock signal.

18. The non-transitory computer-readable recording medium of claim 13, wherein the determining of the idle time periods comprises determining the idle time periods in response to a change in at least one of a resolution or a frame rate of an image signal that is input to the LED display device.

* * * * *